US006764113B1

(12) United States Patent
Cetnar

(10) Patent No.: US 6,764,113 B1
(45) Date of Patent: Jul. 20, 2004

(54) POWERED VEHICLE DOOR LATCH AND ACTUATOR THEREFOR

(75) Inventor: Roman Cetnar, Newmarket (CA)

(73) Assignee: Atoma International Corp., Newmarket (CA)

( * ) Notice: Subject to any disclaimer, the term of this patent is extended or adjusted under 35 U.S.C. 154(b) by 0 days.

(21) Appl. No.: 10/070,874

(22) PCT Filed: Sep. 13, 2000

(86) PCT No.: PCT/CA00/01056

§ 371 (c)(1),
(2), (4) Date: Jul. 19, 2002

(87) PCT Pub. No.: WO01/20112

PCT Pub. Date: Mar. 22, 2001

Related U.S. Application Data

(60) Provisional application No. 60/153,652, filed on Sep. 13, 1999.

(51) Int. Cl.[7] ..... E05L 3/06
(52) U.S. Cl. ..... 292/201; 216/DIG. 23
(58) Field of Search ..... 292/201, 216, 292/DIG. 23

(56) References Cited

U.S. PATENT DOCUMENTS

| | | | | |
|---|---|---|---|---|
| 4,277,964 A | | 7/1981 | Crabb et al. | |
| 4,363,231 A | | 12/1982 | Kaveney, Jr. | |
| 4,487,441 A | | 12/1984 | Miyamoto et al. | |
| 4,492,395 A | | 1/1985 | Yamada | |
| 5,052,731 A | | 10/1991 | Hayakawa et al. | |
| 5,078,436 A | * | 1/1992 | Kleefeldt et al. | 292/201 |
| 5,092,638 A | | 3/1992 | Mizuki | |
| 5,100,185 A | | 3/1992 | Menke et al. | |
| 5,427,421 A | | 6/1995 | Hamaguchi | |
| 5,476,294 A | * | 12/1995 | Menke | 292/216 |
| 5,516,167 A | * | 5/1996 | Hayakawa et al. | 292/337 |
| 5,577,782 A | | 11/1996 | Johnson et al. | |
| 5,603,539 A | * | 2/1997 | Gruhn et al. | 292/216 |
| 5,634,677 A | | 6/1997 | Buscher et al. | |
| 5,639,130 A | | 6/1997 | Rogers, Jr. et al. | |
| 5,667,259 A | | 9/1997 | Torkowski | |
| 5,676,409 A | | 10/1997 | Trammell, Jr. | |
| 5,685,579 A | | 11/1997 | Funk et al. | |
| 5,702,136 A | | 12/1997 | Funk et al. | |
| 5,746,076 A | | 5/1998 | Inoue | |
| 5,802,894 A | * | 9/1998 | Jahrsetz et al. | 70/264 |
| 5,853,206 A | * | 12/1998 | Kleefeldt et al. | 292/201 |
| 5,899,508 A | | 5/1999 | Cetnar et al. | |
| 5,921,594 A | | 7/1999 | Bendel | |
| 5,951,070 A | | 9/1999 | Spurr | |

* cited by examiner

*Primary Examiner*—Robert J. Sandy
*Assistant Examiner*—Carlos Lugo
(74) *Attorney, Agent, or Firm*—Clark Hill PLC

(57) ABSTRACT

A latch assembly has a ratchet that pivots between open and closed conditions selectively cinching a striker. A pawl engages the ratchet. A pawl lever engages the pawl for releasing rotation thereof. An inside release assembly has an inside release lever connected to an inside clutch lever and an override lever. The inside clutch lever selectively engages the pawl lever. Manipulation of the inside release lever selectively releases the pawl lever. An outside clutch lever selectively engages the pawl lever. Manipulation of the outside release lever releases the pawl lever when the outside clutch lever engages the pawl lever. A first motor operably engages a first shaft having a lock cam. A second motor operably engages a second rotatably mounted shaft having a child lock cam. The lock cam is rotatable to engage the inside and outside clutch levers and the override lever.

6 Claims, 5 Drawing Sheets

POWERED VEHICLE DOOR LATCH AND ACTUATOR THEREFOR

This application is a 371 of PCT/CA00/01056 filed Sep. 13, 2000 which claims benefit of Ser. No. 60/153,652 filed Sep. 13, 1999.

FIELD OF THE INVENTION

This invention relates to a latch for a vehicle door. In particular, this invention relates to a powered door latch with a manual override.

BACKGROUND OF THE INVENTION

Vehicle door latch systems are well known in the art. Typically, a vehicle door will have a latch for engaging and cinching onto a striker. The latch will have a rotatably mounted ratchet engaging a pawl in a ratchet relation. The ratchet cooperates with a mouth of a housing to pivot between an open and closed condition for receiving, engaging and cinching a keeper of a striker. The ratchet has a cam surface having abutment surfaces. As the ratchet engages the keeper of a striker, the ratchet rotates in a latching sense and the pawl travels along the cam surface to retain the ratchet in the closed and cinched conditions.

The vehicle door itself has inner and outer manually movable release handles which are operably connected to inner and outer release levers on the latch. To release the latch, the pawl is rotated by responsive movement of either of the inner or outer release levers to disengage the ratchet.

In powered latch systems, as illustrated in WO 98/33998, power actuators are utilized to lock and unlock the latch. These systems embody solenoids, and sometimes, electrical motors with speed reduction gears. There is a need to provide locking assemblies in which the power operation is more versatile and more universally applicable to all of the various and desirable functions which are required with respect to both front doors and rear doors in four door vehicles.

SUMMARY OF THE INVENTION

The disadvantages of the prior art may be overcome by providing a latch assembly and an actuator assembly for a vehicle having a simple mechanism which will lock and unlock the door latch and also provide a mechanism for a manual override.

According to one aspect of the invention, there is provided a latch assembly and actuator assembly for locking and unlocking a vehicle door latch. The latch assembly comprises a latch housing, a ratchet pivotally mounted to the latch housing to pivot between a biased open condition and a closed condition for receiving, engaging and cinching a striker and a pawl pivotally mounted to the latch housing and biased against the ratchet to maintain the ratchet in the closed condition. A pawl lever is operatively coupled to the latch housing and the pawl for effecting releasing rotation of the pawl relative to the ratchet. An inside release assembly comprises an inside release lever pivotally mounted to the latch housing and operably connected to an inside clutch lever and an override lever. The inside clutch lever is moveable to engage and disengage the pawl lever, manipulation of the inside release lever responsively effecting releasing movement of the pawl lever when the inside clutch lever engages the pawl lever. An outside release assembly comprises an outside release lever pivotally mounted to the latch housing and operably connected to an outside clutch lever. The outside clutch lever is moveable to engage and disengage the pawl lever, manipulation of the outside release lever responsively effecting releasing movement of the pawl lever when the outside clutch lever engages the pawl lever. The actuator comprises an actuator housing and a first motor operably engaging a first shaft rotatably mounted in the actuator housing. The shaft has a lock cam mounted thereon. The actuator housing is in mating engagement with the latch housing such that the lock cam is rotatable in the latch housing to engage the inside clutch lever and the outside clutch lever whereby rotation of the lock cam selectively moves at least one of the clutch levers out of engagement with the pawl lever to unlock the latch assembly for releasing the pawl and the ratchet from the closed condition to the open condition.

DESCRIPTION OF THE DRAWINGS

In drawings which illustrate embodiments of the invention.

DESCRIPTION OF THE INVENTION

Figure 1:
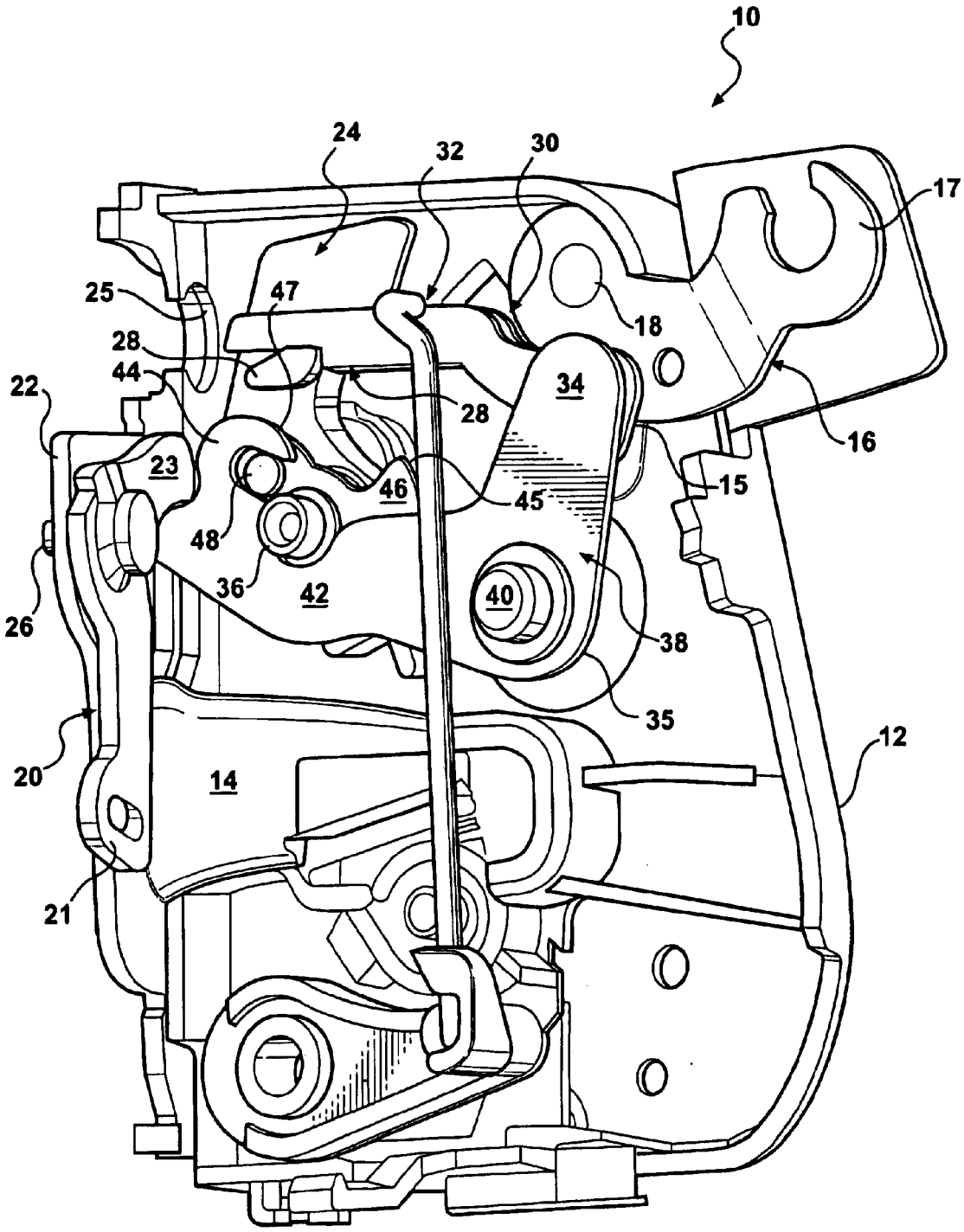
FIG. 1 is a perspective view of the latch assembly of the present invention, with the rear cover plate removed.
Figure 8:
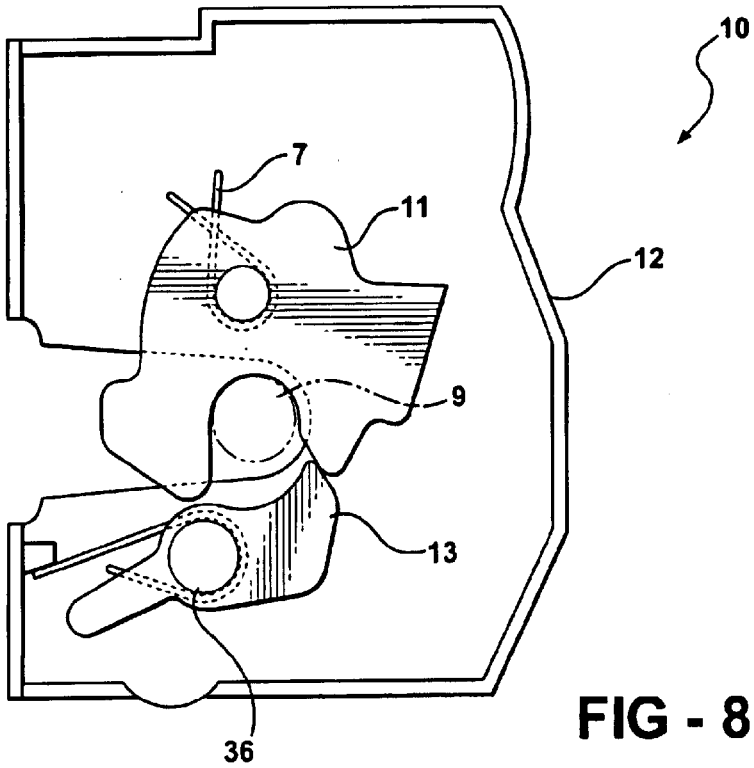
FIG. 8 is a side elevational view of the latch assembly with the ratchet and pawl in a latched, or closed, condition.
Figure 9:
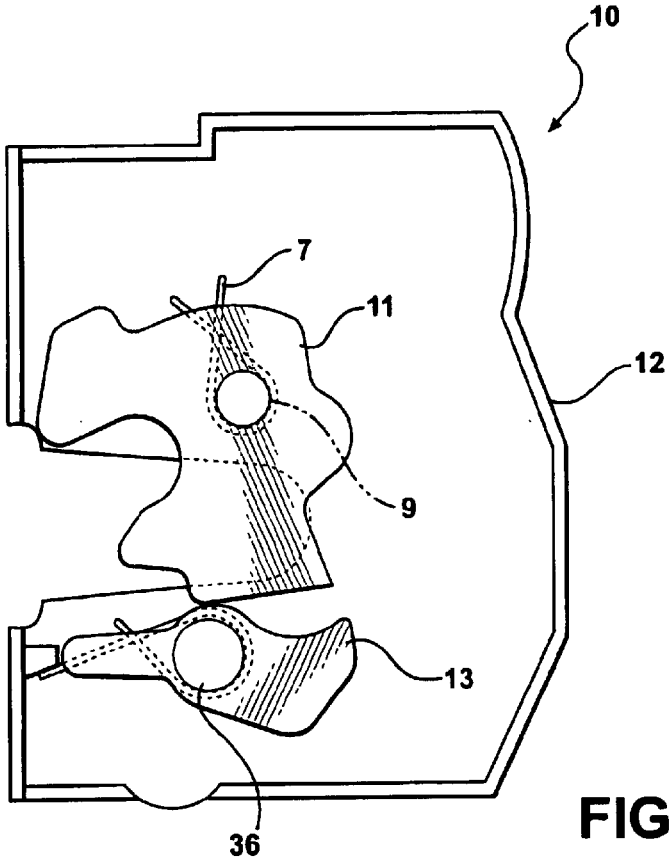
FIG. 9 is a side elevational view of the latch assembly with the ratchet and pawl in an unlatch, or open, condition.

The latch assembly 10 for a vehicle door according to the present invention is generally illustrated in FIG. 1. The latch 10 has a housing 12 having a mouth 14. A ratchet 11 is pivotally mounted to the housing 12 to cooperate with the mouth 14 to pivot between an open condition, as shown in FIG. 9, and a closed condition, as shown in FIG. 8, for receiving, engaging and cinching a striker 9. A pawl 13 is also pivotally mounted to the housing 12 and biased against the ratchet 11 for maintaining the ratchet in the closed condition. A spring 7 is connected between the ratchet 11 and housing 12 to bias the ratchet 11 in an open condition as commonly known to one of ordinary skill in the art.

The latch assembly 10 includes an outside release lever 16 pivotally mounted to the housing 12 at pivot 18. The outside release lever 16 is generally L-shaped and includes heel portion 15 and an opposite C-shaped distal end 17 which is operably connected to an outside door handle on the vehicle door.

The latch assembly 10 further includes an inside release lever 20 pivotally mounted by pivot pin 26 to a flange 22 extending generally perpendicularly from the face of the housing 12. The inside release lever 20 has an L-shape and includes a distal end 21 adjacent the mouth 14 of the housing 12 and a toe portion 23 opposite the distal end 21. The distal end 21 connects to a release cable which is operably connected to an inside door handle on the vehicle door. The inside release lever 20 generally operates in a plane orthogonal to the outside release lever 16 as shown in FIG. 1.

A pawl lever 24 is pivotally mounted on the housing 12 on an opposite side of the housing 12 from the pawl 13 and ratchet 11. The pawl lever 24 is pivotally mounted to housing 12 at pin 36. The pawl lever 24 is operably connected through pin 36 to the pawl 13, on the opposite side of the housing 12, whereby rotation of the pawl lever 24 effects releasing rotation of the pawl 13 which releases the ratchet 11 for opening the latch 10. The pawl lever 24 has tabs 28 on each side thereof and located about mid-length of the lever arm.

Figure 2:
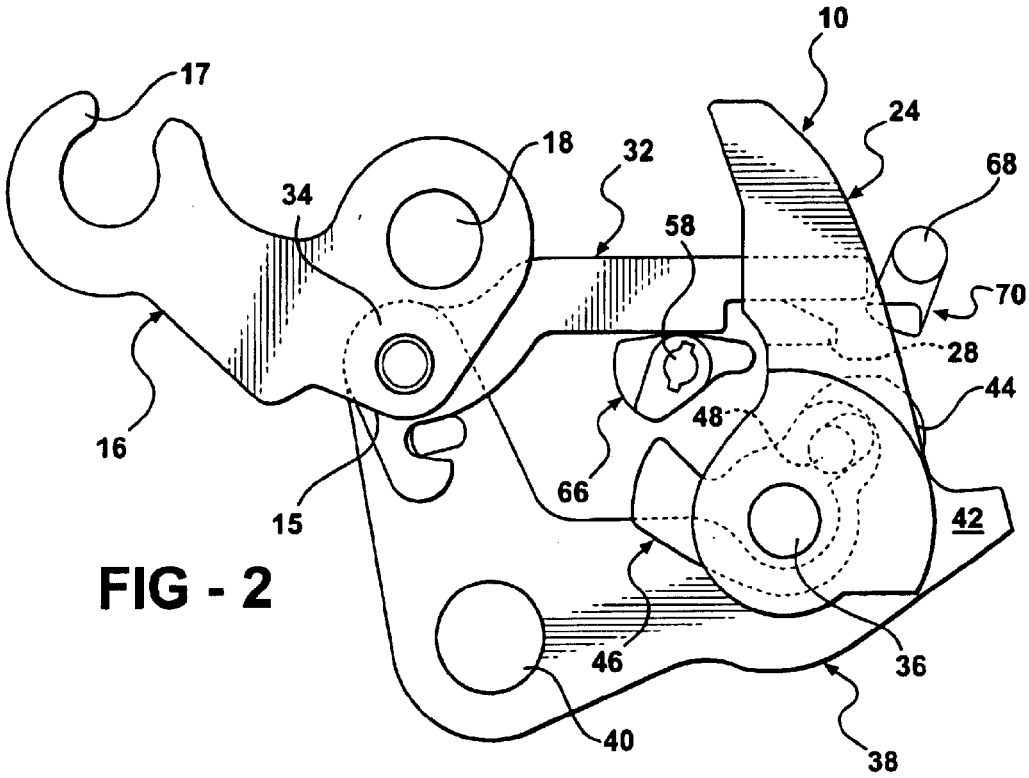
FIG. 2 is a front elevational view of the latch assembly of FIG. 1.

Referring to FIGS. 1 and 2, an outside clutch lever 30 is pivotally connected to the heel portion 15 of the outside release lever 16. The clutch lever 30 is spring biased such that the clutch lever 30 engages one of the tabs 28 on pawl lever 24.

An inside clutch lever 32 is pivotally connected to a toe portion 34 of an auxiliary inside release lever 38. The auxiliary release lever 38 is generally L-shaped and pivotally mounted at a heel portion 35 to the housing 12 by pin 40. The distal end 42 of auxiliary release lever 38 engages the toe portion 23 of the release lever 20. The distal end 42 also has a C-shaped portion 44. The auxiliary release lever 38 is spring biased to abut with pin 36. The inside clutch lever 32 is spring biased to engage an opposite one of the tabs 28 on pawl lever 24. That is, the pawl lever 24 is positioned between the outside clutch lever 30 and the overlying inside clutch lever 32 as shown in FIG. 1.

An override lever 46 is commonly mounted on pin 36. The override lever 46 is L-shaped having a toe end 45 and a heel end 47. The toe end 45 supports a pin 48 which engages the C-shaped portion 44 of the auxiliary release lever 38. As auxiliary release lever 38 rotates, override lever 46 will responsively rotate therewith.

Figure 3:
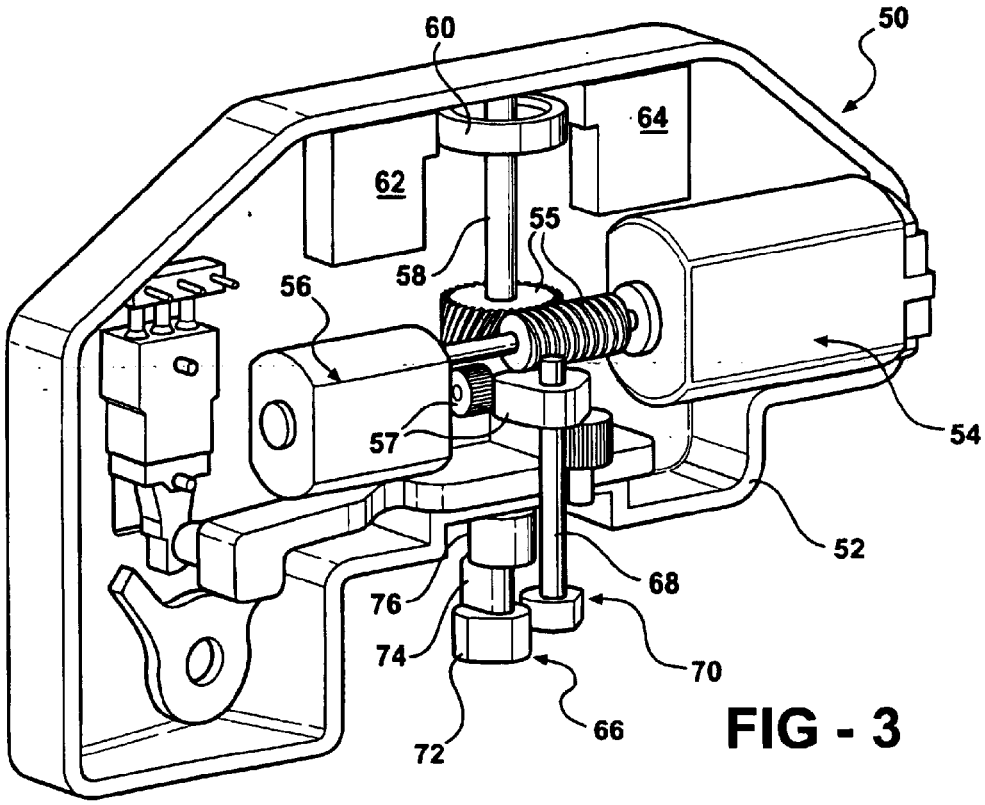
FIG. 3 is a perspective view of the actuator assembly of the present invention.

Referring to FIG. 3, the actuator assembly 50 is illustrated. The actuator assembly 50 comprises a housing 52. The housing 52 supports a first motor 54 and a second motor 56. The first motor 54 operates through a series of gears 55 to rotate a shaft 58 which is rotatably mounted within the housing 52. One end of the shaft has a disc 60 which operates a pair of switches 62, 64. The shaft 58 extends longitudinally outside of the housing 52 to a lock cam 66 mounted at the distal end thereof. The lock cam 66 extends into an opening 25 in the housing 12 of the latch assembly 10 and is positioned to engage the clutch levers 30 and 32.

The second motor 56 also operates through a series of gears 57 to rotate a shaft 68. The shaft 68 also extends longitudinally outside of the housing 52 to a child lock cam 70 mounted at the distal end thereof. The child lock cam 70 extends into the opening 25 in the housing 12 of the latch assembly 10 and is positioned to engage the inside clutch lever 32.

In the preferred embodiment, the lock cam 66 has a first lobe 72, a second lobe 74 and a third lobe 76. The first lobe 72 is sized and positioned to engage the outside clutch lever 30. The second lobe 74 is sized and positioned to engage the inside clutch lever 32, but only after the lock cam 66 has rotated a predetermined amount, preferably 70. The third lobe 76 is sized and positioned to engage the override lever 46 only when the lock c am 66 has rotated the predetermined amount of rotation. In the preferred embodiment, the third lobe 76 is diametrically opposed to the first lobe 72.

The lock cam 66 is rotatable between three different states or conditions: 1) an unlock condition, 2) a single or outside lock condition and 3) a double lock condition. In the unlock condition, the lock cam 66 does not engage either of the clutch levers 30, 32.

In operation, the actuation of either the outside or inside release levers 16, 20 will responsively rotate the pawl lever 24 to unlatch the latch assembly 10. Specifically, referring to FIG. 4, after rotation of the lock cam 66 of a first predetermined amount of rotation by the motors 54, 56, the first lobe 72 will engage the outside clutch lever 30 and will cam the clutch lever 30 out of engagement with the tab 28 of pawl lever 24. Operation of the outside release lever 16 will move the clutch lever 30 but will not cause rotation of the pawl lever 24. The third lobe 76 will be positioned to engage the override lever 46. Operation of the inside release lever 20 is not affected and remains operable. However, rotation of the inside lever 20 will also responsively rotate the override lever 46 which will responsively engage the third lobe 76 and rotate the locking cam 66 to the unlock condition, thus providing manual override.

Figure 4:
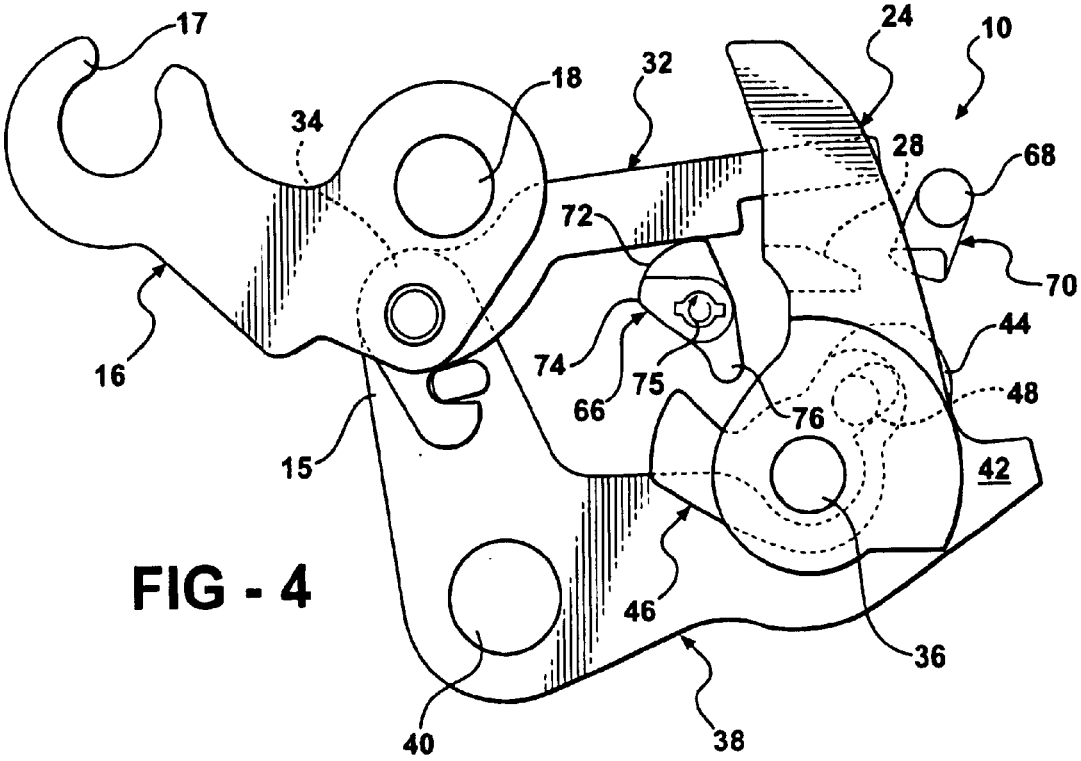
FIG. 4 is a front elevational view of the latch assembly of FIG. 1 in a single lock condition.
Figure 5:
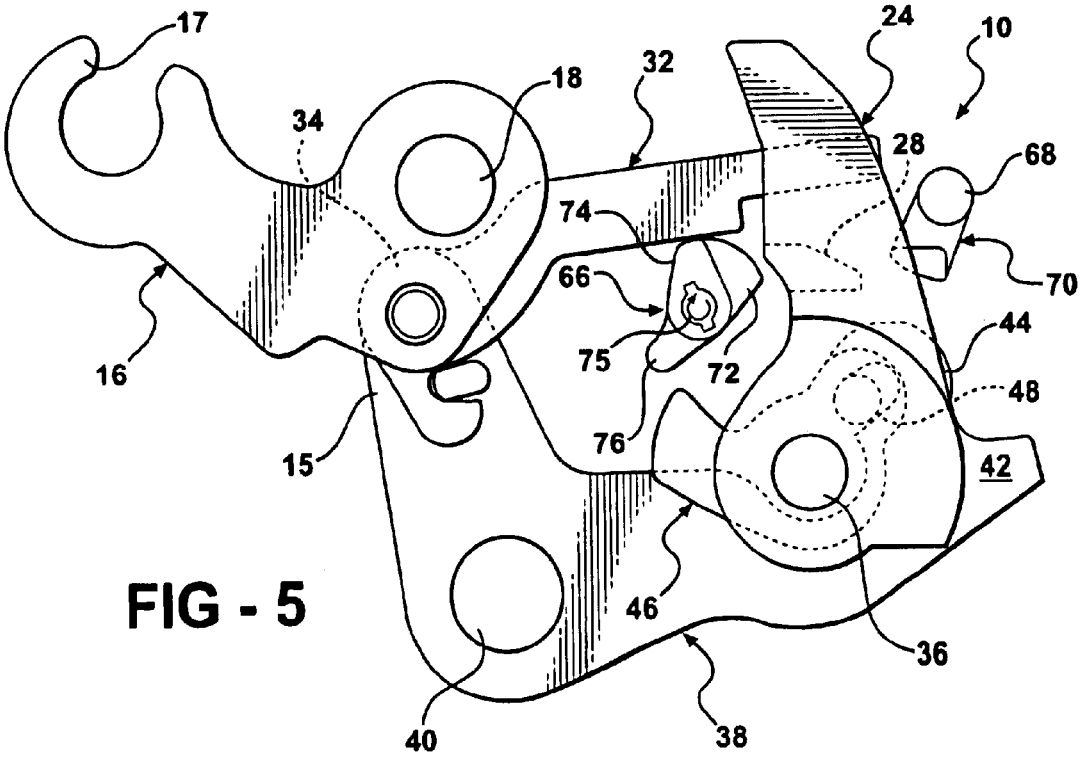
FIG. 5 is a front elevational view of the latch assembly of FIG. 1 is a double lock condition.

Referring to FIG. 5, rotation of the lock cam 66 of a second predetermined amount of rotation, preferably 70, rotates the lock cam 66 to the double lock condition. The first lobe 72 will remain in engagement with the outside clutch lever 30, as shown in FIG. 4, and will also cause second lobe 74 to engage the inside clutch lever 32 to cam the clutch lever 32 out of engagement with the tab 28 of pawl lever 24. The further rotation of cam 66 will rotate the third lobe 76 out of range of the override lever 46. Thus, both the inside release lever 20 and the outside release lever 16 will be disengaged or unlocked and will not effect unlatching of the latch assembly 10.

Figure 6:
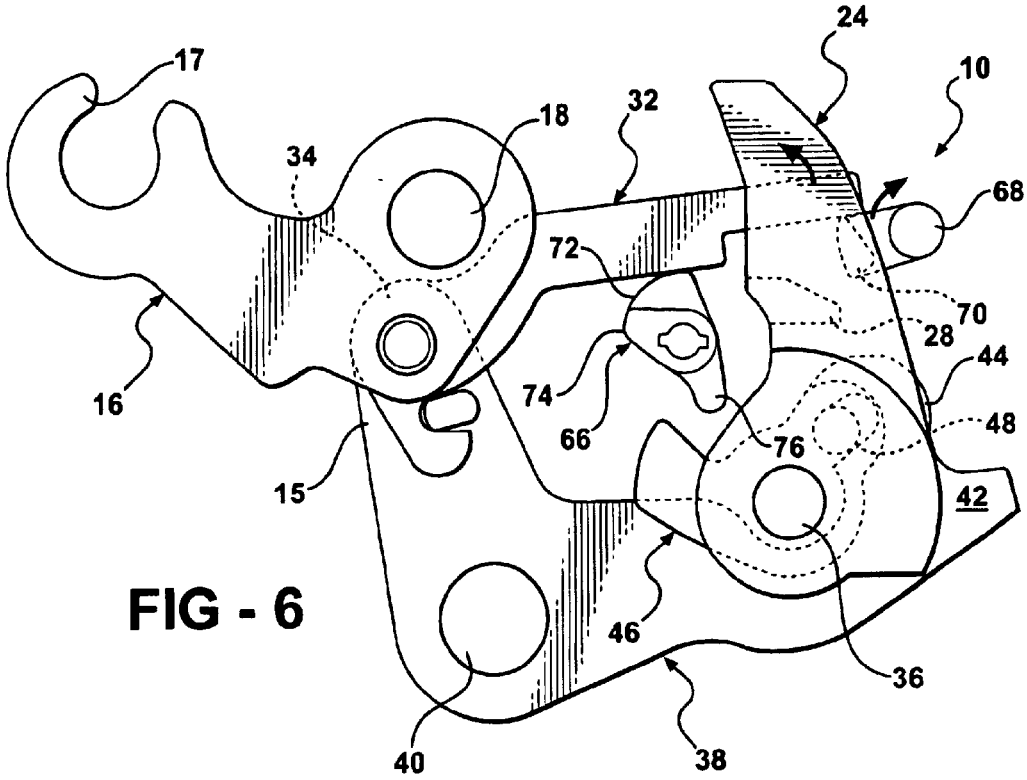
FIG. 6 is a front elevational view of the latch assembly of FIG. 1 in a single lock and child locked condition.

Referring to FIG. 6, child lock cam 70 is positioned to engage the inside clutch lever 32. To activate the child lock function, the child lock cam 70 is rotated by the motors 54, 56 to engage the end of the inside clutch lever 32 to cam the inside clutch lever 32 out of engagement with the tab 28 on the pawl lever 24, rendering the inside release lever 20 ineffectual. However, the override capabilities of the inside release lever 20 is still activated. Operation of the inside release lever 20 will still operate to unlock the latch assembly 10 from the single lock to the unlock condition, allowing releasing by outside release lever 16.

Figure 7:
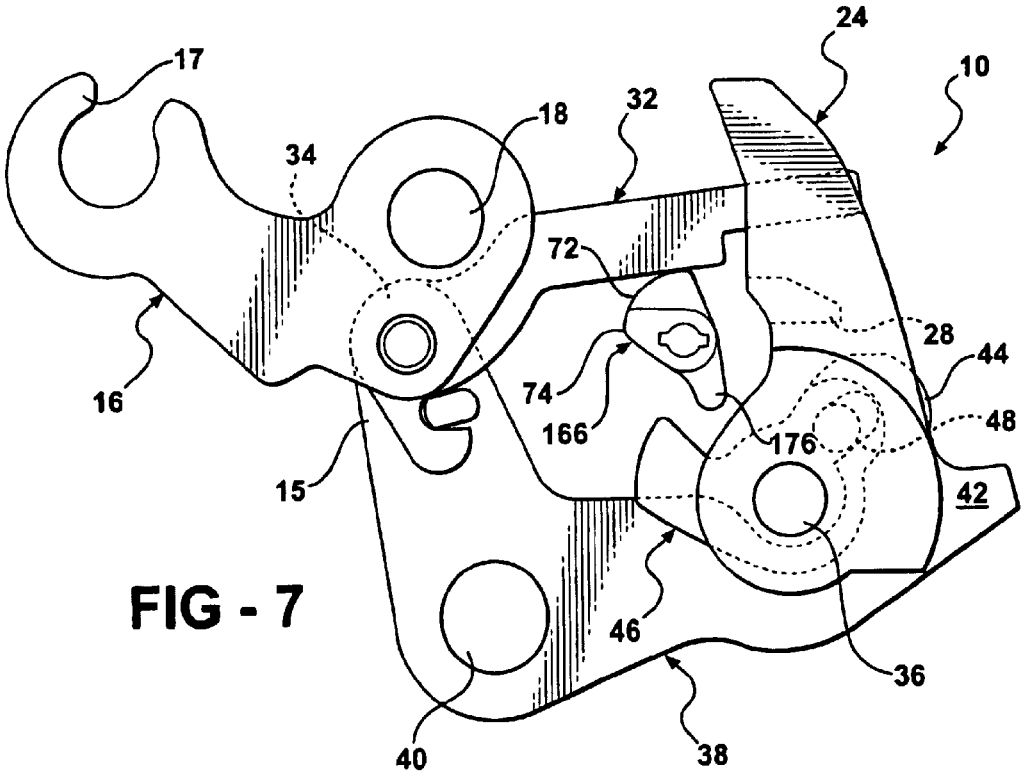
FIG. 7 is a front elevational view of a second embodiment of the latch assembly of the present invention in a locked condition.

Referring to FIG. 7, a second embodiment is illustrated. The lock cam 166 has a single lobe which engages both of the clutch levers 30 and 32 on rotation thereof a first predetermined amount. In effect, the lock assembly 10 has only an unlock condition and a double lock condition with inside release override. The lobe 176 remains in position to engage the override lever 46. A first pull of inside release lever 20 rotates the lock cam 166 from the locked condition to the unlocked condition and then a second pull will unlatch the latch assembly 10.

The preceding specific embodiments are illustrative of the practice of the present invention. It is to be understood, however, that other expedients known or apparent to those skilled in the art or disclosed herein may be employed without departing from the scope of the invention as defined by the appended claims.

What is claimed is:

1. A latch assembly and actuator assembly for locking and unlocking a vehicle door latch, said latch assembly comprising:

a latch housing;

a ratchet pivotally mounted to said latch housing to pivot between an open condition and a closed condition for receiving, engaging and cinching a striker, said ratchet biased to the open condition;

a pawl pivotally mounted to said latch housing and said pawl for effecting releasing rotation of said pawl relative to said ratchet;

a pawl lever operatively coupled to said latch housing and said pawl for effecting releasing rotation of said pawl relative to said ratchet;

an inside release assembly comprising an inside release lever pivotally mounted to said latch housing and operably connected to an inside clutch lever and an override lever, said inside clutch lever moveable to engage and disengage said pawl lever, manipulation of said inside release lever responsively effecting releasing movement of said pawl lever when said inside clutch lever engages said pawl lever;

an outside release assembly comprising an outside release lever pivotally mounted to said latch housing and operably connected to an outside clutch lever, said outside clutch lever moveable to engage and disengage said pawl lever, manipulation of said outside release lever responsively effecting releasing movement of said pawl lever when said outside clutch lever engages said pawl lever;

and said actuator comprising:

an actuator housing, a first motor operably engaging a first shaft rotatably mounted in said actuator housing, said shaft having a lock cam mounted thereon, said lock cam rotatable in said latch housing to engage said override lever whereby rotation of said lock cam selectively moves said lock cam into position for engagement with said override lever to manually override said actuator assembly and rotate said lock cam to an unlocked condition disengaged from both said outside clutch lever and said inside clutch lever;

said actuator housing mating with said latch housing such that said lock cam engages said inside clutch lever and said outside clutch lever whereby rotation of said lock cam selectively moves at least one of said clutch levers out of engagement with said pawl lever to lock said latch assembly and disable manipulation of at lease one of said inside and outside release levers for maintaining said pawl and said ratchet in said closed condition.

2. A latch assembly and actuator assembly as set forth in claim 1, wherein said actuator assembly further includes a second motor operably engaging a second shaft rotatably mounted in said actuator housing, said shaft having a child cam mounted thereon, wherein rotation of said child cam selectively engages said inside clutch lever to disable said inside release lever.

3. A latch assembly and actuator assembly as set forth in claim 2 wherein said lock cam includes a first lobe diametrically opposed from a second lobe for engaging said outside clutch lever and said inside clutch lever, respectively, and a third lobe opposite said first and second lobes for engaging said override lever.

4. A latch assembly and actuator assembly as set forth in claim 3 wherein said lock cam is rotatable within said latch housing from an unlock condition wherein said first lobe and said second lobe are spaced from said respective outside clutch lever and inside clutch lever to a single lock condition wherein said first lobe engages and moves said outside clutch lever out of engagement with said pawl lever to disable said inside release lever.

5. A latch assembly and actuator assembly as set forth in claim 4 wherein said lock cam is rotatable within said latch housing from said single lock condition to said double lock condition wherein said first lobe engages and moves said outside clutch lever out of engagement with said pawl lever to disable said inside release lever and said second lobe engages and moves said inside clutch lever out of engagement with said pawl lever to disable said outside release lever.

6. A latch assembly and actuator assembly as set forth in claim 4 wherein said override lever is operable coupled to said inside release lever for engaging said third lobe to rotate said lock cam from said single lock condition to said unlock condition in response to manual manipulation of said inside release lever to manually override said actuator assembly and unlock said latch assembly.

* * * * *

UNITED STATES PATENT AND TRADEMARK OFFICE

CERTIFICATE OF CORRECTION

PATENT NO. : 6,764,113 B1
DATED : July 20, 2004
INVENTOR(S) : Cetnar

It is certified that error appears in the above-identified patent and that said Letters Patent is hereby corrected as shown below:

Column 3,
Line 63, please delete “preferably 70” and insert -- as is shown in Figure 3 --.

Column 4,
Line 23, please delete “preferably 70” and insert -- geographically represented by arrow 75 --.

Column 6,
Line 1, please delete “lease” and insert -- least --.

Signed and Sealed this

Fourteenth Day of September, 2004

JON W. DUDAS
*Director of the United States Patent and Trademark Office*